US005435753A

United States Patent [19]

Werner

[11] Patent Number: 5,435,753

[45] Date of Patent: Jul. 25, 1995

[54] PLUG AND SOCKET CONNECTOR

[75] Inventor: Klaus Werner, Betzdorf, Germany

[73] Assignee: ELCO Europe GmbH, Betzdorf, Germany

[21] Appl. No.: 149,228

[22] Filed: Nov. 9, 1993

[30] Foreign Application Priority Data

Nov. 10, 1992 [DE] Germany ..... 42 37 914.8

[51] Int. Cl.[6] ..... H01R 13/66

[52] U.S. Cl. ..... 439/620; 439/931; 333/182; 333/185

[58] Field of Search ..... 439/108, 620, 931; 333/206, 222, 181–185

[56] References Cited

U.S. PATENT DOCUMENTS 4,992,060 2/1991 Meyer ..... 439/620

5,176,526 1/1993 Hillbish et al. ..... 439/74

FOREIGN PATENT DOCUMENTS 1490590 7/1969 Germany .

3148351 7/1982 Germany .

8811471 11/1988 Germany .

*Primary Examiner*—Gary F. Paumen

*Attorney, Agent, or Firm*—Friedrich Kueffner

[57] ABSTRACT

A plug and socket connector, particularly with filtering and/or shielding, is composed of two connector halves, for examples, a female or male multi-point connector and a printed circuit board or the like. The base member of one connector half has pin-like connecting elements and the base member of the other connector has corresponding receiving openings or spring contacts. Between always two receiving openings for contacts, a metal-coated cutout is provided. In an electric plug-type connection, the receiving openings of the base member receiving the pin-like connecting elements are provided with a suitable metal contact.

8 Claims, 1 Drawing Sheet

PLUG AND SOCKET CONNECTOR

BACKGROUND OF THE INVENTION

1. Field of the Invention

The present invention relates to a plug and socket connector, particularly with means for filtering and/or shielding the individual contacts. The connector is composed of two connector halves, for example, a female or a male multi-point connector and a printed circuit board or the like. The base member of one of the connector halves has pin-like or peg-like connecting elements and the base member of the other connector half has corresponding receiving openings or spring contacts.

2. Description of the Related Art

Filtered connector parts of the above-described type are used, for example, in electronic devices, such as personal computers, controls and devices with high-frequency inputs or outputs or the connections thereof. In plug and socket connectors with filter, it is known to solder discreet capacitors onto the peg-like connecting elements which are preferably constructed as cylindrical pins, or onto the corresponding connections of the spring contacts. Alternatively, several small capacitor plates, for example, with two or more integrated capacitors, are mounted and soldered onto the base member. The soldering of individual capacitors is very time consuming and poses technical difficulties. The mounted capacitor plates frequently lead to problems because, since ceramic material is relatively brittle, it cannot be prevented that the capacitor plates crack or burst as a result of the coefficient of expansion during temperature changes.

SUMMARY OF THE INVENTION

Therefore, it is the primary object of the present invention to provide a plug and socket connector of the above-described type which can be easily manufactured and does not have the above-described disadvantages. Specifically, it is the object of the present invention to provide a plug and socket connector which does not require individual capacitors being soldered and/or mounted thereon.

In accordance with the present invention, between always two receiving openings for contacts, a metal-coated cutout is defined in the base member. If the metal coating is to serve for shielding purposes, it is recommended that the cutout is a through opening, for example, in the form of a slot.

In accordance with another proposal of the invention, the receiving openings of the base member receiving the peg-like connecting elements have a suitable metal contact; alternatively, the receiving openings are metallized, i.e., the receiving openings are coated with a suitable metal coating. The metal-coated receiving openings are suitable for receiving spring pins. If filtering and/or shielding is desired in this arrangement of contacts, metal-coated cutouts or through openings must additionally be provided between the receiving openings.

The insulating body or base member, which may be composed of ceramic material or plastic material, has a defined dielectric which forms a capacitor together with the peg-like metal pin and the metal coated cutout.

Suitable contact materials, such as gold, nickel or tin, are to be used for metallizing or metal-coating the cutouts or through openings of the base member.

In the plug and socket connector according to the present invention, the peg-like connecting elements, which also may be constructed as jack-type contacts, form one electrode of a capacitor at those locations where they are facing or are arranged opposite a metal-coated surface of the through opening; the metal-coated surface forms the second electrode of the capacitor.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

DETAILED DESCRIPTION OF THE PREFERRED EMBODIMENTS

Figure 1:
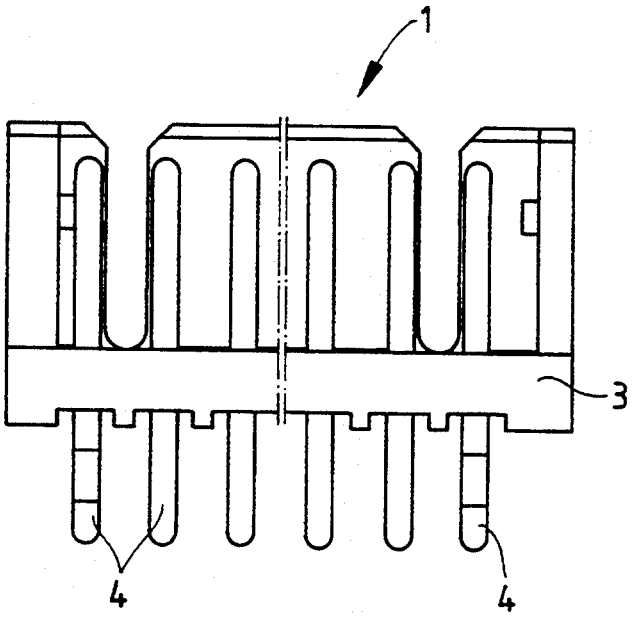
FIG. 1 is a schematic front view of a connector half of a plug and socket connector, wherein the connector half is provided with peg-like connecting elements.
Figure 2:
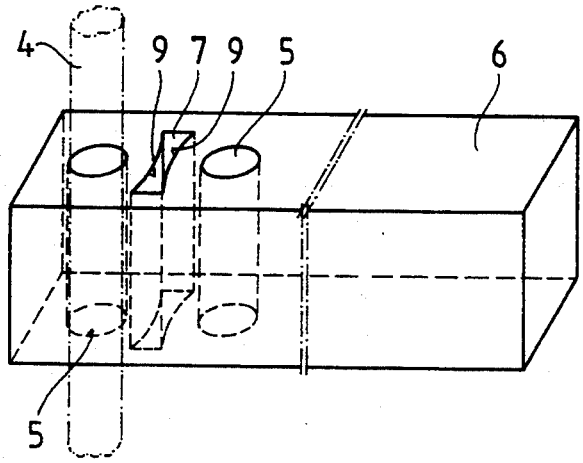
FIG. 2 is a perspective schematic view of a second connector half provided with metal-coated contact surfaces according to the present invention.

A plug and socket connector according to the present invention is composed of a connector half 1 shown in FIG. 1 and a connector half 2 shown in FIG. 2.

The connector half 1 has a base member 3 which is of plastics material and/or ceramic material. The base member 3 has a plurality of spaced-apart peg-like connecting elements which are constructed as cylindrical or square pins 4.

Figure 3:
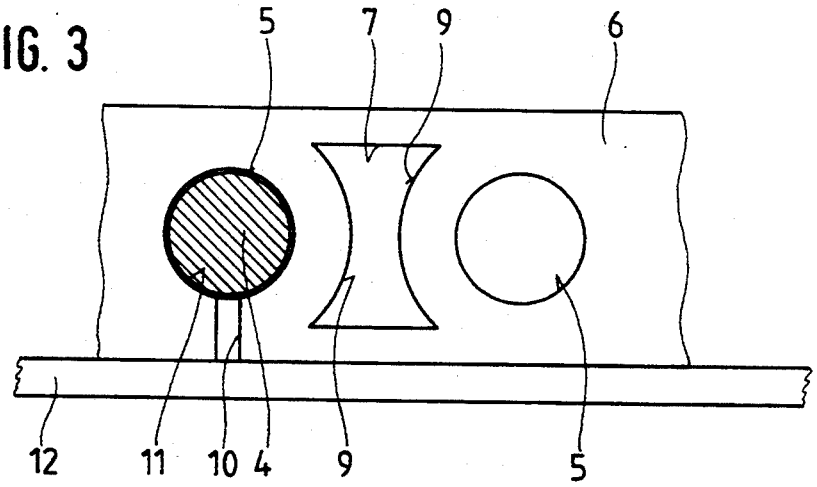
FIG. 3 is a partial top view of the connector half shown in FIG. 2.

The connector half 2 to be connected to the connector half 1 also has a base member 6 of plastics material or ceramic material. For connecting the connector halves 1, 2, the base member 6 of connector half 2 has receiving openings 5 for receiving the pins 4 of the connector half 1. The number of receiving openings 5 corresponds to the number of pins 4 of the connector half 1. For clarity sake, FIGS. 2 and 3 show only two receiving openings. In addition, the receiving openings 5 have a cross-section which corresponds in shape to the cylindrical or square shape of the pins 4.

As can be seen particularly in FIGS. 2 and 3, a slot-shaped through opening 7 is provided in the base member 3. The through opening 7 extends through the base member 3 between the two receiving openings 5 and in the same direction as the receiving openings 5. A metal coating of the outer surface of the base member provides a ground connection of the capacitor coating obtained by the metallized through opening 7. As shown in FIG. 3, at least the inner surfaces 9 of the through openings 7 facing the two receiving openings 5 are provided with a metal contact material coating and, thus, are metallized. Alternatively, a capacitor can be produced in the insulating or base member 3 by providing the inner surface of one of two oppositely located receiving openings 5 with a metal coating 11, i.e., the inner surface is metallized. When a spring-type pin engages the respective metallized receiving openings, the spring pin provides the required electric contact. In this case, as illustrated in the drawing, a metallized through opening 7 or cutout between the receiving holes 5 is necessary if filtering or shielding is desired.

As shown in FIG. 3, the inner surfaces 9 of the through opening 7 extend parallel to the adjacent surfaces of the receiving openings 5 or the pins 4. In other words, the inner surfaces 9 have an arched shape corresponding to the cylindrical pin or the cylindrical receiving opening 5 resulting in as hourglass-shaped cross-section of the through opening 7. In this manner, it is possible to influence the capacity of the arrangement. Accordingly, because of the metal coating of the through openings 7 of the base member 6 and/or the metal coating 11 of alternating receiving openings 5, it is no longer necessary to solder on individual capacitors in a cumbersome manner or to mount capacitor plates each having two or three capacitors. The metal coating of the through opening 7 between two contacts or pins 4, in the case of the connection of this metal coating with ground, simultaneously provides shielding of the two contacts relative to each other and, thus, prevents cross-talking. The inner surfaces 9 of the through-opening 7 may also extend at an angle relative to the adjacent surfaces of the receiving openings 5 or the pins 4.

As shown in FIG. 3, strip conductors 10 metallized onto the base member connect the metal coating of the receiving opening 5 to a printed circuit board 12. The through opening 7 connected to ground forms a capacitor together with the metal coating of the receiving opening 5 or with a metal pin 4 inserted into the receiving opening 5. Base members of ceramic or plastics material, which are provided with metal-coated receiving openings 5, form an electric plug and socket connection together with the spring metal pins 4 inserted into the openings. When metal-coated cutouts or through openings 7 are provided between two contacts or pins 4, the two contacts are shielded relative to each other.

The invention is not limited by the embodiments described above which are presented as examples only but can be modified in various ways within the scope of protection defined by the appended patent claims.

I claim:

1. A plug and socket connector comprising a plug portion and a socket portion, the plug portion and the socket portion each having a base member, a plurality of pin-shaped connecting elements being mounted on the base member of the plug portion, the base member of the socket portion defining receiving openings for receiving the connecting elements, the number of receiving openings corresponding to the number of connecting elements, spacings existing between adjacent receiving openings, the base member of the socket portion further defining a cutout in each spacing between two said receiving openings, the cutout having an hourglass-shaped cross-section and having a surface, further comprising a metal coating on the surface of the cutout.

2. The connector according to claim 1, wherein the cutout is through opening extending through the base member of the socket portion.

3. The connector according to claim 1, wherein the receiving openings have surfaces, the surfaces of the receiving openings comprising metal coatings.

4. The connector according to claim 1, wherein the receiving openings and the cutouts have adjacent surfaces, and wherein the adjacent surfaces extend parallel to each other.

5. The connector according to claim 3, comprising strip conductors on the base member of the socket portion for connecting the metal coating of the receiving openings to a printed circuit board.

6. The connector according to claim 1, wherein the base members are of ceramic material.

7. The connector according to claim 1, wherein the base members are of plastic material.

8. The connector according to claim 3, wherein the connecting elements received in the metal-coated receiving openings are spring pins.

* * * * *